US005862572A

United States Patent [19]

Lin et al.

[11] Patent Number: 5,862,572

[45] Date of Patent: Jan. 26, 1999

[54] LOCKABLE HANDLE SYSTEM FOR WHEELED LUGGAGE

[75] Inventors: Jerhong Lin; Chung Hsien Kuo, both of Taipei County, Taiwan

[73] Assignee: Chaw Khong Company, Ltd., Taipei County, Taiwan

[21] Appl. No.: 967,845

[22] Filed: Nov. 12, 1997

Related U.S. Application Data

[60] Provisional application No. 60/030,652, Nov. 12, 1996.

[51] Int. Cl.[6] ..... A47B 95/02

[52] U.S. Cl. ..... 16/115; 280/655; 119/18 A

[58] Field of Search ..... 16/115; 190/18 A, 190/39, 115–117; 280/37, 655, 655.1, 47.31, 47.317

[56] References Cited

U.S. PATENT DOCUMENTS 5,502,876 4/1996 Wang ..... 16/115
5,628,088 5/1997 Chen ..... 16/115
5,692,266 12/1997 Tsai ..... 16/115
5,704,725 1/1998 Horing ..... 190/18 A
5,727,898 3/1998 Lu ..... 280/655

*Primary Examiner*—Chuck Y. Mah
*Attorney, Agent, or Firm*—Tung & Associates

[57] ABSTRACT

The present invention discloses a lockable handle system for a wheeled luggage that includes a lock housing, a push shaft and a sliding lock pin assembled in an inner tubing of the pull handle system such that during normal usage, a button on the push shaft protrudes from the top surface of the pull handle and the sliding lock pin engages the inner tubing to the outer tubing of the pull handle such that the handle system is locked in place. When the handle system is to be released and extended for usage, the button on the push shaft can be pressed down to retract the sliding locking pin from the outer tubing back into the inner tubing and thereby releasing the inner tubing and enabling it to be extended away from the outer tubing.

14 Claims, 3 Drawing Sheets

LOCKABLE HANDLE SYSTEM FOR WHEELED LUGGAGE

This application claims the benefit of U.S. Provisional Application No. 60/030,652, filed Nov. 12, 1996.

FIELD OF THE INVENTION

The present invention generally relates to a lockable handle system and more particularly, relates to a lockable handle system that is suitable for use on a wheeled luggage.

BACKGROUND OF THE INVENTION

Wheeled luggage has been popularly used in recent years by travelers in either airplane or any other forms of traveling. In the development of a wheeled luggage, several important and desirable characteristics must be satisfied. First, the luggage needs to be rigidly constructed and to have sufficient rigidity to survive rough handling on the streets, in and out of buildings having ascending or descending steps, and in and out of various forms of carriers such as a motor vehicle, a train or an airplane. Secondly, the wheeled luggage should have adequate wheel means such that a traveler can pull a luggage along on a pavement or other surfaces with relative ease. Thirdly, the wheeled luggage should have a convenient handle system such that it can be stowed securely when not in use. Wheeled luggage available in the market today do not have means for locking a handle system. This creates problems when the luggage is being shipped and handled, i.e., at an airport. When the luggage is positioned sideways or in an upside down position, the gravity of the handle may extend the handle such that various problems can occur such as damages to an automated luggage conveyor system.

It is therefore an object of the present invention to provide a wheeled luggage that is equipped with a handle system which does not have the drawbacks or shortcomings of a conventional handle on a wheeled luggage.

It is another object of the present invention to provide a wheeled luggage that is equipped with a handle system that can be locked during shipment of the luggage.

It is a further object of the present invention to provide a wheeled luggage that is equipped with a lockable handle system that prevents the handle from being extended accidentally.

SUMMARY OF THE INVENTION

In accordance with the present invention, a wheeled luggage that is equipped with a handle system that can be locked when the luggage is being shipped or stowed is provided.

In a preferred embodiment, the wheeled luggage is equipped with a lockable handle system that includes a lock housing, a push shaft, and a sliding lock pin assembled in an inner tubing of the pull handle system such that during normal usage, a button on the push shaft protrudes from the top surface of the pull handle and the sliding lock pin engages the inner tubing to the outer tubing of the pull handle system such that the handle system is locked in place. When the handle system is to be released and extended for usage, the button on the push shift can be pressed down to retract the sliding locking pin from the outer tubing back into the inner tubing and therefore releasing the inner tubing and enabling it to be extended away from the outer tubing.

The present invention is further directed to a method of locking a handle system in a wheeled luggage by using a push shift and a sliding lock pin installed in the inner tubing of the system such that the inner tubing and the outer tubing are locked together by the sliding locked pin when the handle is in a stowed position.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention provides a wheeled luggage that has a lockable handle system wherein a lock housing, a push shift and a sliding lock pin are assembled in the inner tube of the pull handle system such that the inner tube can be locked to the outer tube when the handle is in a stowed position.

Figure 1:
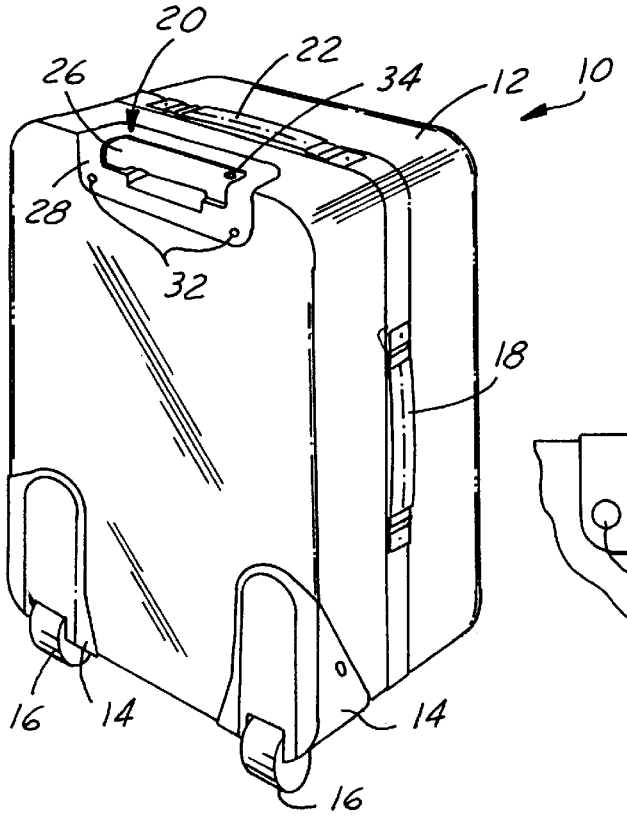
FIG. 1 is a perspective view of a wheeled luggage equipped with the present invention lockable handle system viewed from the back.

Referring initially to FIG. 1, where a perspective view of the backside of a wheeled luggage 10 having the present invention lockable handle system 20 installed thereon is shown. The body 12 of the luggage can be made of a molded plastic shell or a ballistic-type nylon canvas material for durability. A pair of plastic molded corners 14 are provided such that wheels 16 can be mounted therein. Two carrying handles 18 and 22 are provided on the side of luggage 10 and on the top of luggage 10, respectively for ease of carrying.

The lockable handle assembly 20 includes a pull handle 26, an external bezzle 28, mounting screws 32 and a push button 34. The push button 34 is provided on top of a push shaft (shown in FIG. 3) and is used to unlock the pull handle system 20 such that the pull handle 26 can be released and pulled out into an extended position. The detailed structure of the lockable handle assembly 20 will be explained in FIG. 3.

Figure 2:
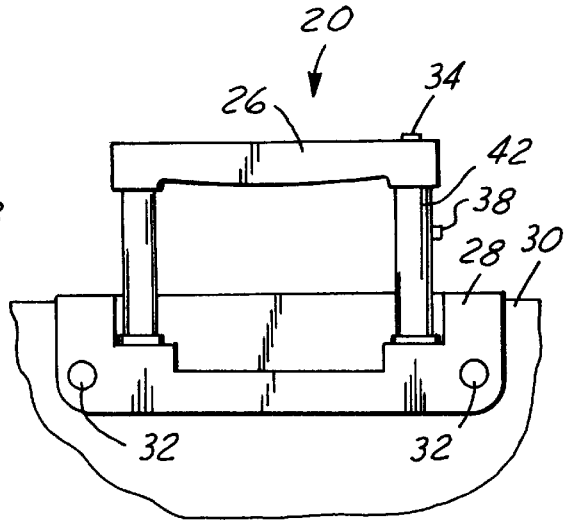
FIG. 2 is an enlarged, back side view of the present invention lockable handle system.

FIG. 2 shows an enlarged, rear side view of the lockable handle system 20 in an unlocked or extended position. The pull handle 26 is pulled up after button 34 is depressed and lock pin 38 is retracted into the inner tubing 42 and thus allowing the inner tubing 32 and the pull handle 26 to be extended away from the external bezzle 28. The external bezzle 28 is fastened to the rear side 30 of the wheel luggage 10 by mechanical attachment means 32, i.e., by screws.

Figure 3A:
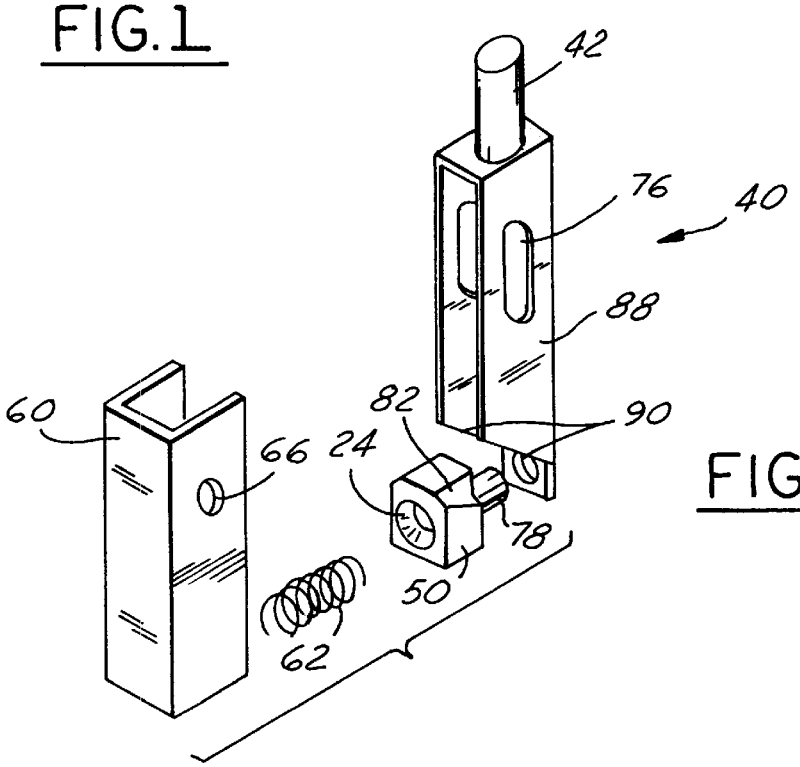
FIG. 3A is an enlarged, perspective view of the push shaft and the sliding lock pin of FIG. 3.
Figure 3:
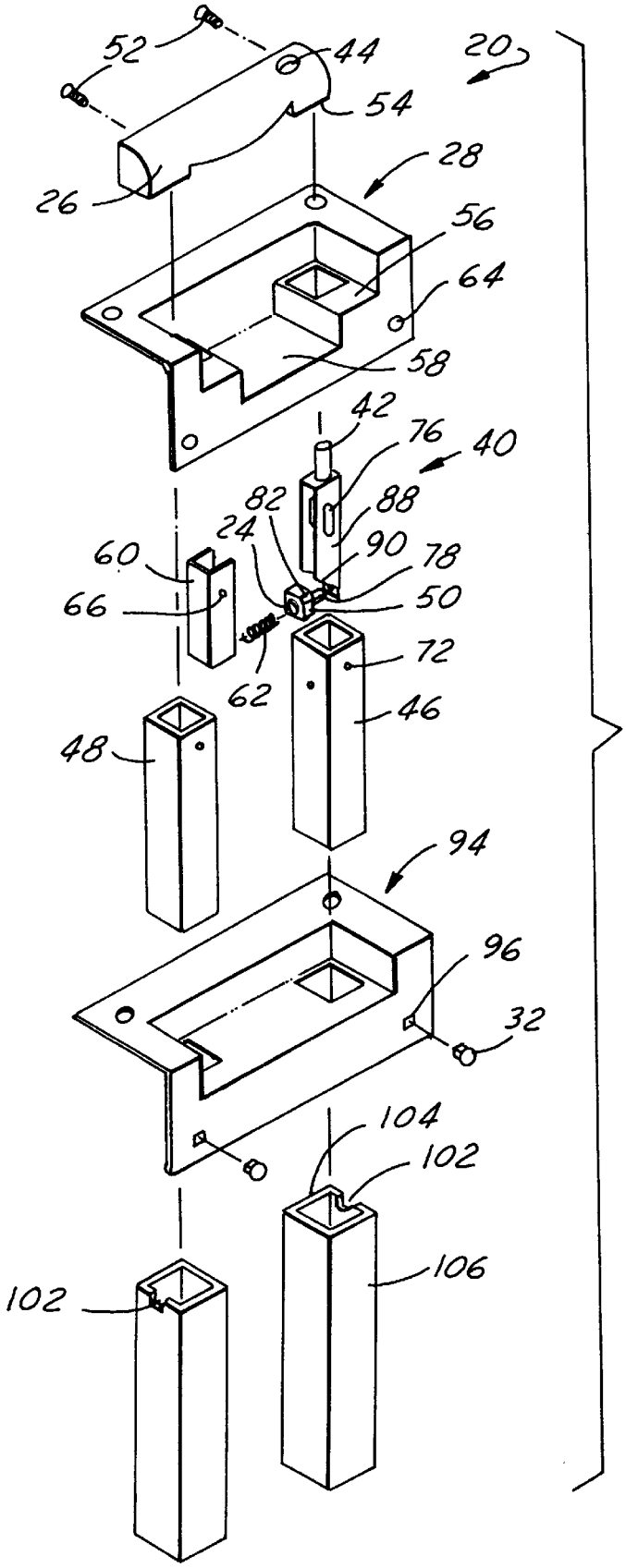
FIG. 3 is a perspective view of the components used in the lockable handle system of the present invention.

Referring now to FIG. 3, where an enlarged, exploded view of the various components of the present invention lockable handle system 20 is shown. From the top of FIG. 3, pull handle 26 which has an aperture 44 to allow the installation of a push shaft 40 and its protruded button 42 is shown. Pull handle 26 is mounted to inner tubings 46, 48 through a screw hole (not shown) and screws 52. When the pull handle 26 is in a stowed position, the bottom surface 54 of the pull handle rests on a raised platform 56 in the external bezzle 28. The molded-in recess 58 in the external bezzle 28 allows easy gripping of the pull handle 26 by a human hand when the handle is in a locked position.

In an assembled position, the push shaft 40 rests in the lock housing 60 with spring 62 and sliding lock pin 50 positioned thereinbetween. The assembly is then installed in the inner tubing 46 and is locked in placed by a pin (not shown) through hole 66 in the lock housing 60, hole 72 in the inner tubing 46 and elongated slot 76 in the push shaft 40. The sliding lock pin 50 is generally constructed of a square cross-section havin a circular shaped recess 24 on one side and a dowel 78 on the other side. The sliding lock pin 50 is further equipped with inclined ridges 82 in the shoulder portion on both sides of the generally square shape. The inclined ridges 82 have an angle with the vertical axis of less than 45°. The thickness of the inclined ridges 82 on the sliding lock pin 50 is generally similar to the thickness of the two opposing plates 88 on the push shaft 40. At the bottom ofthe push shaft 40, the two ends of plates 88 are also inclined to an angle substantially the same as that of the ridges 82 on the sliding lock pin 50. The angle of the incline at the bottom of plates 82 is also smaller than 45° measured from the vertical axis. An enlarged perspective view of the push shaft 40, the sliding lock pin 50, the spring 62 and the locking housing 60 is shown in FIG. 3A.

It should be noted that the elongated slot 76 in the push shaft 40 when engaged by a pin (not shown) through holes 72 in the inner tubing 46 allows an up-and-down motion of the push shaft 40 when force is exerted on the push button 42 protruding from the top surface of the pull handle 26. The inclined surfaces 90 at the bottom of the push shaft 40 engage with the inclined ridges 82 on the sliding lock pin 50 and thereby transfers an up-and-down motion of push shaft 40 into a horizontal motion of the sliding lock pin 50 to push dowel 78 through a hole (not shown) in the inner tubing 46 into holes 102 located at the top edge 104 of the outer tubing 106.

The internal bazzle 94, when mounted, is located inside the wheeled luggage 10 and therefore cannot be seen from the outside of the luggage. The internal bezzle 94 can be mounted to the rear panel 30 of the wheeled luggage 10 and then to the external bazzle 28 through mounting holes 96 and 64 by screws 32. The inner tubing 46 can slide in and out of the outer tubing 106 freely by pushing down button 42 on the push shaft 40 and pulling on the pull handle 26.

Figure 4:
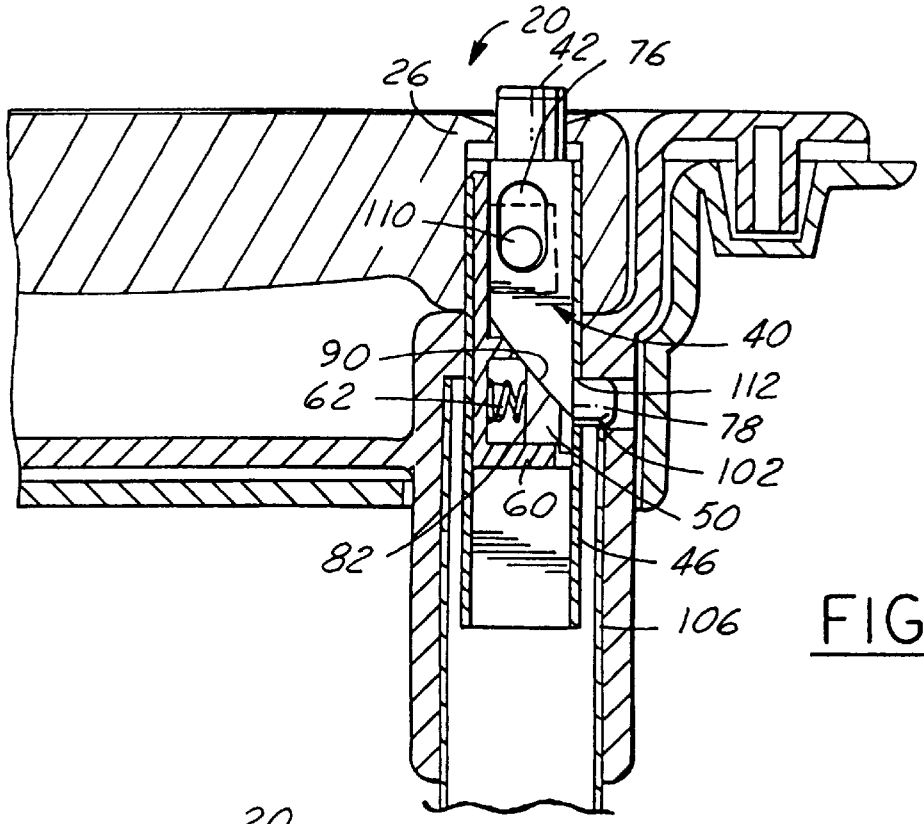
FIG. 4 is an enlarged, cross-sectional view of the present invention lockable handle system showing the handle in a locked position.

An enlarged, cross-sectional view of the lockable handle assembly in a locked position is shown in FIG. 4. In FIG. 4, the spring 62 is in an uncompressed condition and therefore push on the sliding lock pin 50 such that dowel 78 penetrates through hole 112 in the inner tubing 46 into hole 102 in the outer tubing 106. The inclined bottom edges 90 of the push shift rests on the inclined ridges 82 on the sliding lock pin 50 when the button 42 is unpushed. This is the normal position of the lockable handle system 20, i.e., button 42 protrudes from the top surface of handle 26 while lock pin 78 locks the inner tubing 46 and the outer tubing 106 together.

Figure 5:
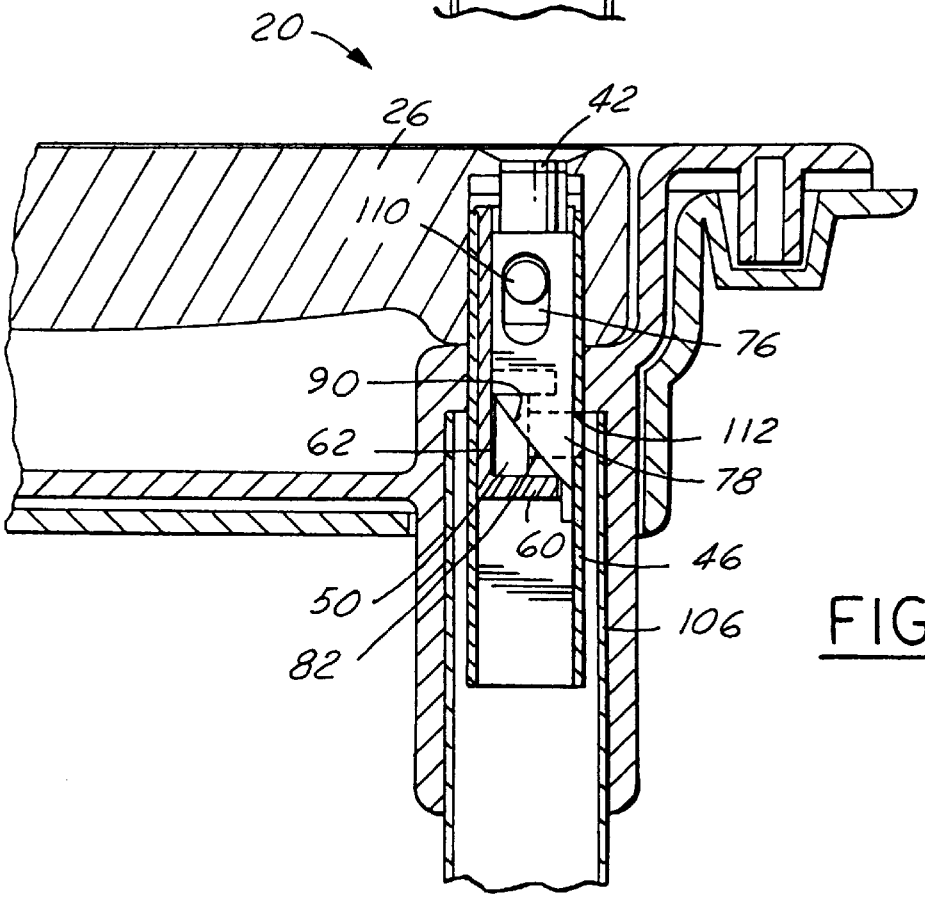
FIG. 5 is an enlarged, cross-sectional view of the present invention lockable handle system showing the handle in an unlocked position.

When the release of handle 26 and extension of the inner tubing 46 are desired, as shown in FIG. 5 button 42 on the push shaft 40 is pushed down and the downward motion of the push shift is stopped by pin 110 and the upper end of the elongated slot 76. In such a position, spring 62 is compressed and retracts into recess 76 of the sliding lock pin 50. The dowel 78 therefore is pulled back and disengages from the outer tube 106 and stays flush with the inner tube 46 at aperture 112. The inclined bottom edges 90 on the push shaft 40 engages the inclined ridges 82 on the sliding lock pin 50 in a similar way as previously shown in FIG. 4. The sliding lock pin 50 generally rests on the bottom of the lock housing 60. After button 42 is pressed down and handle 26 is pulled up, button 42 can be released and pin 78 resumes its protruded position when the inner tube 46 is extended and exposed outside the outer tube 106. This is shown in FIG. 2 where button 34 and lock pin 38 are both in a protruded position.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

We claim:

1. A locking mechanism for locking an inner tube to an outer tube comprising:

an outer tube of an elongated shape containing a cavity therein adapted for sliding engagement with an inner tube, and an aperture in one wall adapted for receiving a dowel, an inner tube of an elongated shape having an outer periphery substantially similar to an inner periphery of said outer tube, and an aperture in one wall adapted for receiving a dowel, a locking means mounted inside said inner tube, said locking means comprises:

a push shaft consisting of two opposing parallel plates joined by a side plate and a button on top of the shaft, an elongated slot in each of said two opposing, parallel plates for mounting to said inner tube while allowing an up-and-down motion of said shaft to a displacement substantially equal to a length of said elongated slot, an inclined lower end on said two opposing, parallel plates having a predetermined angle, and an aperture in said side plate adapted for receiving a dowel therethrough, a sliding lock pin having a generally rectangular shaped body, a dowel on one side and a cavity on the opposite side receiving a spring mounted therein, said body having a ridge on each side of the body formed at an angle from a top surface of said body substantially similar to and adapted for engaging said predetermined angle on the lower end of said parallel plates on said push shaft, and a shaft housing for receiving said push shaft, said sliding lock pin and said spring therein for mounting inside said inner tube, whereby when an external force is exerted on said button on top of said shaft, said push shaft moves downwardly such that the inclined lower end on said two opposing, parallel plates engage the ridges on said body of the sliding lock pin and thereby transforms a downward motion of said push shaft into a horizontal motion of said sliding lock pin by withdrawing said dowel from said aperture in said outer tube such that said inner tube may slide freely in said outer tube.

2. A locking mechanism according to claim 1, wherein said outer tube being affixed to a wheeled luggage.

3. A locking mechanism according to claim 1, wherein said inner tube and said outer tube having generally a rectangular cross-section.

4. A locking mechanism according to claim 1, wherein said locking means is affixed to said inner tube by a pin mounted through apertures in said inner tube, said shaft housing, and the elongated slot in said push shaft.

5. A locking mechanism according to claim 1, wherein said push shaft has a generally U-shaped configuration.

6. A locking mechanism according to claim 1, wherein said predetermined angle of said inclined lower end on said two opposing parallel plates is between about 30° and about 60°.

7. A locking mechanism according to claim 1, wherein said shaft housing is generally a U-shaped bracket having an aperture therethrough for mounting said locking means to said inner tube.

8. A lockable handle system for a wheeled luggage comprising:

a pair of parallelly positioned and spaced apart outer tubes, each of said tubes having an open upper end and an interior cavity adapted for receiving an inner tube to slide freely therein, an open lower end for fixing to a wheeled luggage and an aperture therethrough adapted for receiving a dowel on a locking means for locking said inner and outer tubes together, a U-shaped handle assembly comprises a handle grip and two inner tubes positioned spaced apart in a parallel relationship each having an upper end affixed to the handle grip, a lower end slidingly engaging the interior cavity of the outer tube and an aperture therethrough adapted for receiving a dowel on a locking means, said handle grip having a aperture therein for receiving a button on a locking means for dis-engaging said locking means and thereby unlocking said inner tube from said outer tube, a locking means mounted inside one of said inner tubes, said locking means comprises:

a push shaft consisting of two opposing parallel plates joined by a side plate and a button on top of the shaft, an elongated slot in each of said two opposing parallel plates for mounting to said inner tube while allowing an up-and-down motion of said shaft to a displacement substantially equal to a length of said elongated slot, an inclined lower end on said two opposing parallel plates having a predetermined angle, and an aperture in said side plate adapted for receiving a dowel to slide therethrough, a sliding lock pin having a generally rectangular shaped body having a dowel on one side and a cavity on the opposite side receiving a spring mounted therein, said body having a ridge on each side of the body formed at an angle from a top surface of said body substantially similar to and adapted for engaging said predetermined angle on the lower end of said parallel plates on said push shaft, and a shaft housing for receiving said push shaft, said sliding lock pin and said spring therein for mounting inside said inner tube, whereby when an external force is exerted on said button on top of said shaft, said push shaft moves downwardly such that the inclined lower ends on said two opposing, parallel plates engage the ridges on said body of the sliding lock pin and thereby transforms a downward motion of said push shaft into a horizontal motion of said sliding lock pin by withdrawing said dowel from said aperture in said outer tube such that the inner tube slide freely in said outer tube.

9. A lockable handle system for a wheeled luggage according to claim 8, wherein said inner tubes and said outer tubes having generally a rectangular cross-section.

10. A lockable handle system for a wheeled luggage according to claim 8, wherein said locking means is affixed to said inner tube by a pin mounted through apertures in said inner tube, said shaft housing, and the elongated slot in said push shaft.

11. A lockable handle system for a wheeled luggage according to claim 8, wherein said push shaft has a generally U-shaped configuration.

12. A lockable handle system for a wheeled luggage according to claim 8, wherein said predetermined angle of said inclined lower end on said two opposing parallel plates is between about 30° and about 60°.

13. A lockable handle system for a wheeled luggage according to claim 8, wherein said shaft housing is generally a U-shaped bracket having an aperture therethrough for mounting said locking means to said inner tube.

14. A lockable handle system for a wheeled luggage according to claim 8, wherein said locking means is affixed to a cavity in said inner tube at a position substantially close to the top of said inner tube such that when said locking means engages said outer tube, the handle system is in a stowed position.

* * * * *